US005404200A

United States Patent [19]

Martin et al.

[11] Patent Number: 5,404,200

[45] Date of Patent: Apr. 4, 1995

[54] METHOD AND APPARATUS FOR A SELF-RECOVERING FUSER AND IMAGE RECEPTOR

[75] Inventors: Michael J. Martin, Hamlin; Jacob N. Kluger, Rochester; Lloyd W. Durfey, Palmyra; Gerald M. Garavuso, Rochester; Kathleen M. Laffey, Hamlin; Steven R. Moore, Rochester; Robert P. Siegel, Penfield; Russell J. Sokac, Rochester, all of N.Y.

[73] Assignee: Xerox Corporation, Stamford, Conn.

[21] Appl. No.: 80,632

[22] Filed: Jun. 22, 1993

[51] Int. Cl.[6] ..... G03G 21/00

[52] U.S. Cl. ..... 355/207; 355/212; 355/282; 355/315

[58] Field of Search ..... 355/315, 205, 206, 207, 355/316, 211, 212, 282

[56] References Cited

U.S. PATENT DOCUMENTS

| | | | |
|---|---|---|---|
| T105,201 | 3/1985 | Pries et al. . | |
| 3,843,407 | 10/1974 | Thorp | 355/299 X |
| 4,073,585 | 2/1978 | Kobayashi et al. | 355/207 |
| 4,244,648 | 1/1981 | Schultes et al. | 355/206 |
| 4,247,193 | 6/1981 | Kaneko et al. | 355/206 |
| 4,281,623 | 8/1981 | Kato et al. | 355/315 X |
| 4,320,961 | 3/1982 | Davis et al. | 355/206 |
| 4,443,101 | 4/1984 | Sakurai et al. | 355/207 |
| 4,952,982 | 8/1990 | Tabuchi | 355/316 |

FOREIGN PATENT DOCUMENTS

| | | | |
|---|---|---|---|
| 0062278 | 5/1981 | Japan . | |
| 0052664 | 3/1983 | Japan | 355/315 |
| 0184383 | 10/1984 | Japan | 355/315 |
| 0002165 | 1/1986 | Japan | 355/207 |
| 0181977 | 6/1992 | Japan | 355/315 |

*Primary Examiner*—Robert B. Beatty
*Attorney, Agent, or Firm*—Oliff & Berridge

[57] ABSTRACT

An automatic recovery apparatus reduces the number of shut downs due to fuser misstrips in an electrophotographic device. A fuser misstrip occurs if the lead edge of a copy sheet does not emerge from the fuser nip. The fuser roller and the photoreceptor drive roller are stopped. These rollers are driven in the reverse direction until the copy sheet is released from the fuser. The rollers are then driven in the forward direction so that the copy sheet is re-fused. This automatic recovery apparatus is used for a photoreceptor misstrip. If the copy sheet remains attached to the photoreceptor belt after passing the stripping zone, it will jam in the cleaner module. If a sensor detects the copy sheet is still attached to the belt after the stripping zone, then the photoreceptor belt is reversed and the stripping procedure is repeated.

34 Claims, 7 Drawing Sheets

METHOD AND APPARATUS FOR A SELF-RECOVERING FUSER AND IMAGE RECEPTOR

BACKGROUND OF THE INVENTION

1. Field of the Invention

This invention relates to improvements in the operation of a fuser in a photocopying machine. More particularly, this invention has a self-recovering feature which lowers the number of paper jams which occur at the fuser and at the cleaner module.

2. Description of the Related Art

In electrophotographic applications such as xerography, a charge retentive surface is electrostatically charged. A light pattern formed from the original image to be reproduced selectively discharges the charge on a retentive surface. The resulting pattern, a combination of charged and discharged areas on the charge retentive surface, form an electrostatic charge pattern (an electrostatic latent image) conforming to the original image. The latent image is developed by contacting it with a finely divided electrostatically attractable powder referred to as "toner". Toner is held on the image area by the electrostatic charge on the surface. Thus, a toner image is produced in conformity with a light image of the original being produced. The toner image may then be transferred to a substrate (e.g., paper), and the toner is fused onto the substrate by passing through a fuser. At this point the image is affixed to the substrate and is ejected from the machine to the holding tray. The process is well known, and is useful for light lens copying from an original, and printing applications from electronically generated or stored originals, where a charged surface may be discharged in a variety of ways. Ion projection devices where a charge is imagewise deposited on a charge retentive substrate operate similarly.

Occasionally a copy sheet will jam in a variety of places in a xerography machine. In order to reduce the number of paper jams perceived by the operator, it is necessary that certain jam situations be identified and recovered from automatically. This includes fuser misstrips and photoreceptor misstrips. Depending on paper path architecture, each of these jam situations may require the photoreceptor (assumed to be a belt) to stop and back up a short distance so that recovery can take place.

In a copier or a printer, a copy with toned (black) lead edge is known to cause fuser misstrip problems. In addition, copies without a black lead edge often fail to strip from a fuser roll due to toner contamination of the fuser roll, improper fuser oil metering, and aging of the fuser roll surface. In either case, the sheet is held to the roll by the fused toner. If a misstrip occurs the processor paper path shuts down in a hard stop. The operator must intervene, clear the jammed copy and perform any reordering of the original that is required.

SUMMARY OF THE INVENTION

The proposed strategy to reduce the number of hard shut downs due to fuser misstrips relies on backing the misstripped copy sheet out of the fuser, stripping the copy sheet from the fuser roll and re-fusing the copy sheet. Since the lead edge of the copy sheet has already been fused and stripped from the roll, it is easier to strip a second time.

A fuser misstrip will occur if the lead edge of a copy sheet does not emerge from the fuser nip. The fuser roller and the photoreceptor drive roller are stopped. After the fuser roller is reversed for a short time, a small amount of buckle will be created between the transfer zone and the fuser subassembly. The two rollers are reversed in unison so that the copy sheet is sent to the fuser sub-assembly for a second time.

Another method of reducing the number of hard stops due to fuser misstrips is to reverse both the fuser roller and the photoreceptor drive roller in unison. After a fuser misstrip has been identified, the fuser roller and the photoreceptor drive roller are stopped. Both rollers are driven in the reverse direction until the copy sheet has been removed from the fuser subassembly. The two rollers are driven in the forward direction so that the copy sheet is sent to the fuser sub-assembly for a second time.

Another example of eliminating hard shutdowns is during a photoreceptor misstrip. The paper remains attached to the photoreceptor belt and continues toward a cleaner module which cleans the belt. The paper will jam in the cleaner module if left on the belt. The photoreceptor misstrip is detected via a "paper on photoreceptor" sensor located a short distance downstream of the strip zone. Once detected, the paper path enters a recovery mode. The photoreceptor drive roller stops and then backs up to re-expose the tacked sheet's lead edge to the detack corotron field. The photoreceptor drive roller then moves forward to attempt stripping once again.

BRIEF DESCRIPTION OF THE DRAWINGS

The invention is illustrated in the accompanying drawings, in which like reference numerals are used to note like or similar parts, and wherein.

DETAILED DESCRIPTION OF THE PREFERRED EMBODIMENTS

Figure 1:
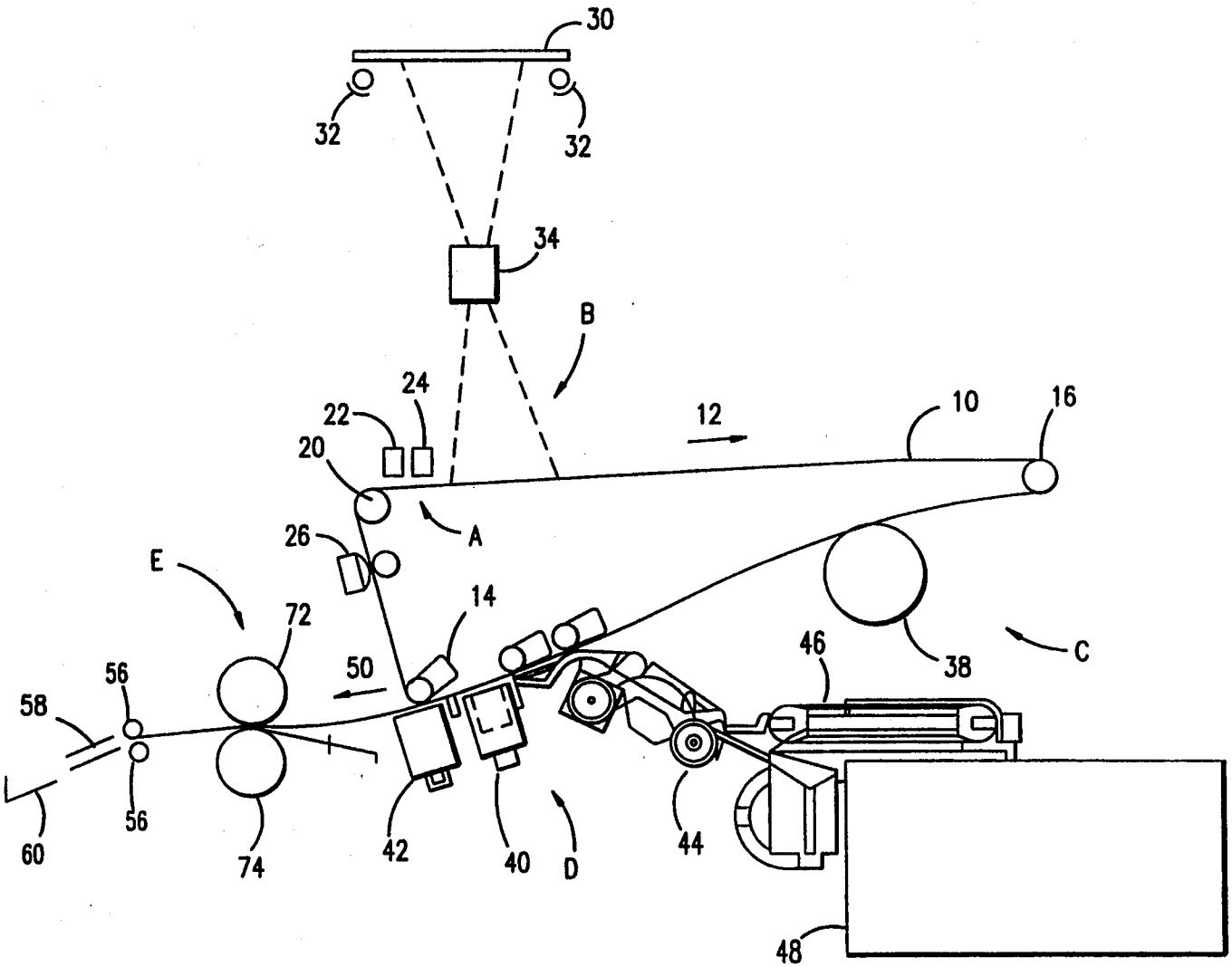
FIG. 1 is a mechanical representation of a xerography machine.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original. Accordingly, a reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16 and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 14 and tension roller 16 are rotatably mounted. These rollers are also idlers which rotate freely as belt 10 moves in the direction of arrow 12.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a magnetic brush developer unit 38 advances a developer mix (i.e. toner and carrier granules) into contact with the electrostatic latent image. The latent image attracts the toner particles from the carrier granules thereby forming toner powder images on photoreceptor belt 10.

Belt 10 then advances the developed latent image to transfer station D. At transfer station D, a sheet of support material such as a copy sheet (paper) is moved into contact with the developed latent image on belt 10. First, the latent image on belt 10 is exposed to a pre-transfer light from a lamp (not shown) to reduce the attraction between photoreceptor belt 10 and the toner powder image thereon. Next a corona generating device, a transfer corotron 40, charges the copy sheet to the proper potential so that it is tacked to photoreceptor belt 10 and the toner powder image is attracted from photoreceptor belt 10 to the copy sheet. After transfer, a detack corotron 42 charges the copy sheet to an opposite polarity to detack the copy sheet from belt 10, whereupon the sheet is stripped from belt 10 at stripping roller 14. A cleaner module 26 is located before the charging station A. The cleaner module 26 removes excess toner from the belt 10.

Copy sheets are advanced to transfer station D from a supply tray 48, which may hold different quantities, sizes and types of support materials. Copy sheets are advanced to transfer station D along conveyor 46 and rollers 44. After transfer, the copy sheet continues to move in the direction of arrow 50 to fusing station E.

Fusing station E includes a fuser assembly, which permanently affixes the transferred toner powder images to the copy sheets. Preferably, the fuser assembly includes a heated fuser roller 72 adapted to be pressure engaged with a pressure roller 74 (also called a back-up roller.) The toner powder image on the copy sheet is pressed against the heated fuser roller 72. In this manner, the toner powder image is permanently affixed to the copy sheet.

After fusing, copy sheets bearing fused images are directed through decurler 56. Chute 58 guides the advancing sheet from decurler 56 to catch tray or a finishing station 60 for binding, stapling, collating, etc. and removal from the machine by the operator. Alternatively, the sheet may be advanced to a duplex tray (not shown) from which it will be returned to the processor for receiving a second side copy.

Figure 2:
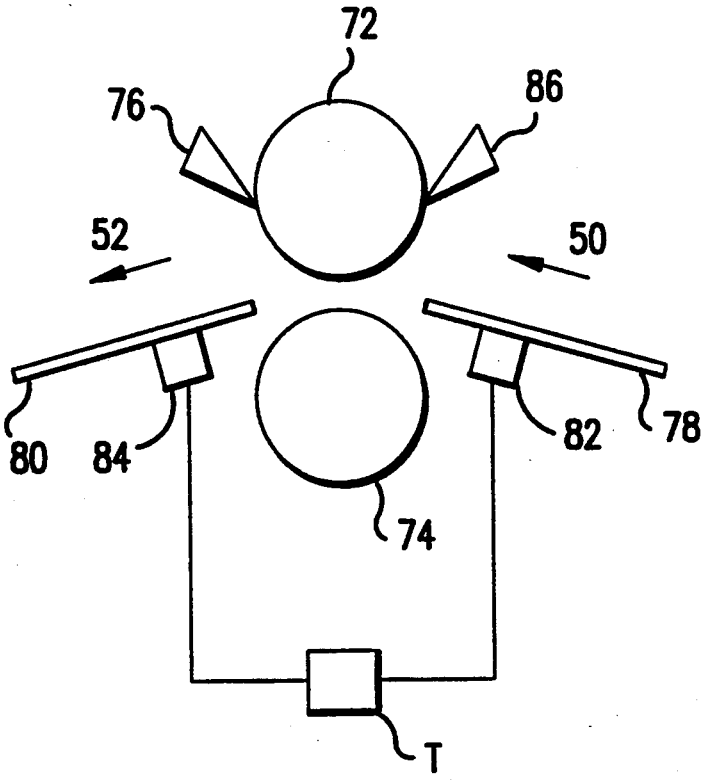
FIG. 2 is a diagram of the self-recovering fuser assembly of the present invention.

In accordance with one embodiment of the invention, and with reference to FIG. 2, a self-recovering fuser sub-assembly is shown. A heated fuser roller 72 is attached to a motor (not shown) which allows the fuser roller to move in the clockwise and counterclockwise direction. The fuser roller can be thermally heated to a temperature that allows the toner to fuse to the paper. A pressure roller 74 applies pressure to the fuser roller so that the paper is firmly held against the fuser roller. A pre-fuser sensor 82 is attached to a pre-fuser paper guide 78. A post-fuser sensor 84 is attached to a post-fuser paper guide 80. A recovery stripper fingers 86 and standard stripper fingers 76 are mounted in contact with the fuser roller 72. The purpose of these stripper fingers will be discussed later.

Figure 3:
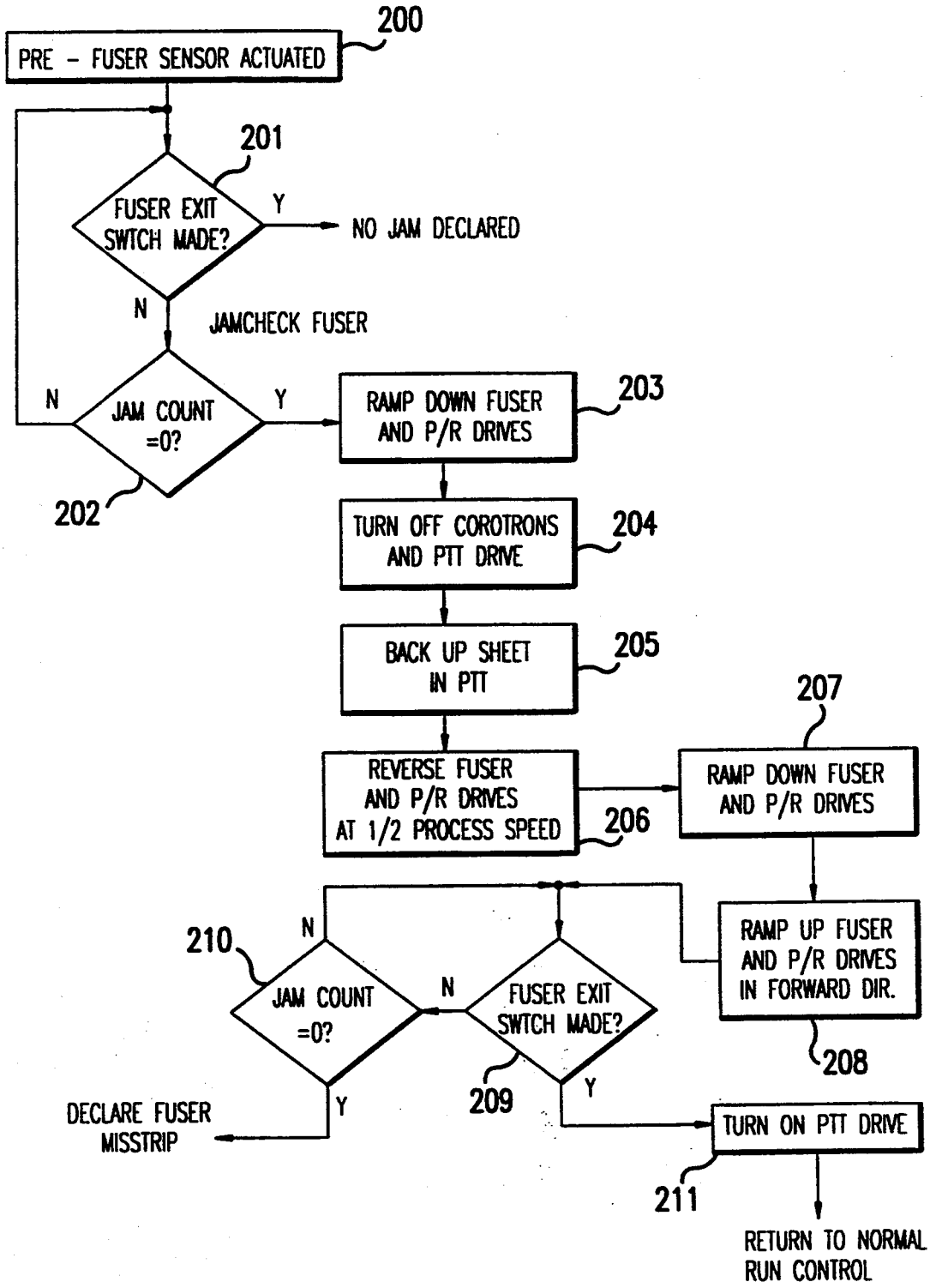
FIG. 3 is a flowchart for controlling fuser misstrip recovery.

FIG. 3 shows the control process for a fuser misstrip recovery. First, the copy sheet with the toner already adhered to it is moved toward the fuser roller 72 by the assistance of the pre-fuser paper guide 78. In step 200, the lead edge of the copy sheet will pass by the pre-fuser sensor 82 to initiate a timer T.

When no paper jam occurs, the copy sheet will pass between the fuser roller 72 and pressure roller 74 toward the post-fuser paper guide 80. At step 201, it will be determined whether the copy sheet has reached the post-fuser sensor 84 before the timer times out. If so, the post-fuser sensor 84 will halt the timer as the copy sheet passes by it, therefore, no paper jam has occurred. In this case, the timer is reset for the next copy sheet to enter the fuser sub-assembly. If the copy sheet has not reached the post-fuser sensor 84, step 202 determines whether the timer has timed out. If time remains on the timer, then control returns to 201 to determine whether the post-fuser sensor 84 has been activated.

When a paper jam occurs in the fuser roller, the following scenario will occur. As the counter is decreasing for a period of time, the post-fuser sensor 84 fails to be triggered by the lead edge of the copy sheet. When the counter is at zero in step 202, then the fuser sub-assembly determines that a paper jam has occurred.

Step 203 is performed where the fuser roller and the photoreceptor drive roller are slowed down until they stop. An internal software clock is substituted for the machine clock which is lost when the photoreceptor belt is stopped. In step 204 the detack corotron 42, the transfer corotron 40 and the paper transport systems are shut down. In step 205, the sheets in the paper transport system are backed up.

In step 206, the fuser roller and the photoreceptor drive roller are reversed at one-half process speed for a predetermined number of clock counts to back the lead edge of the copy sheet out of the fuser nip without causing excessive sheet damage or smear. The recovery stripper fingers 86 are used to help strip the lead edge of the sheet from the fuser roller upon reversal. After the fuser roller and the photoreceptor drive roller have moved a sufficient amount to clear the jammed copy sheet from the fuser, the fuser roller and the photoreceptor drive roller are stopped again in step 207.

In step 208, the fuser roller and the photoreceptor drive roller are moved in the forward direction at normal process speed. The timer T is reset and begins again counting down in step 209 until the post-fuser sensor 84 senses the lead edge of the copy sheet. The timing window limit is expanded to compensate for possible sheet damage. If the post-fuser sensor 84 is not actuated before the timer T reaches zero, then a second fuser misstrip is declared in step 210. The operator may need to intervene and remove the jammed copy sheet or another attempt at an automatic recovery may be initiated. If the post-fuser sensor 84 is actuated by the lead edge of the copy sheet, then the recovery process proceeds to the step 211 to reestablish normal control.

Figure 4:
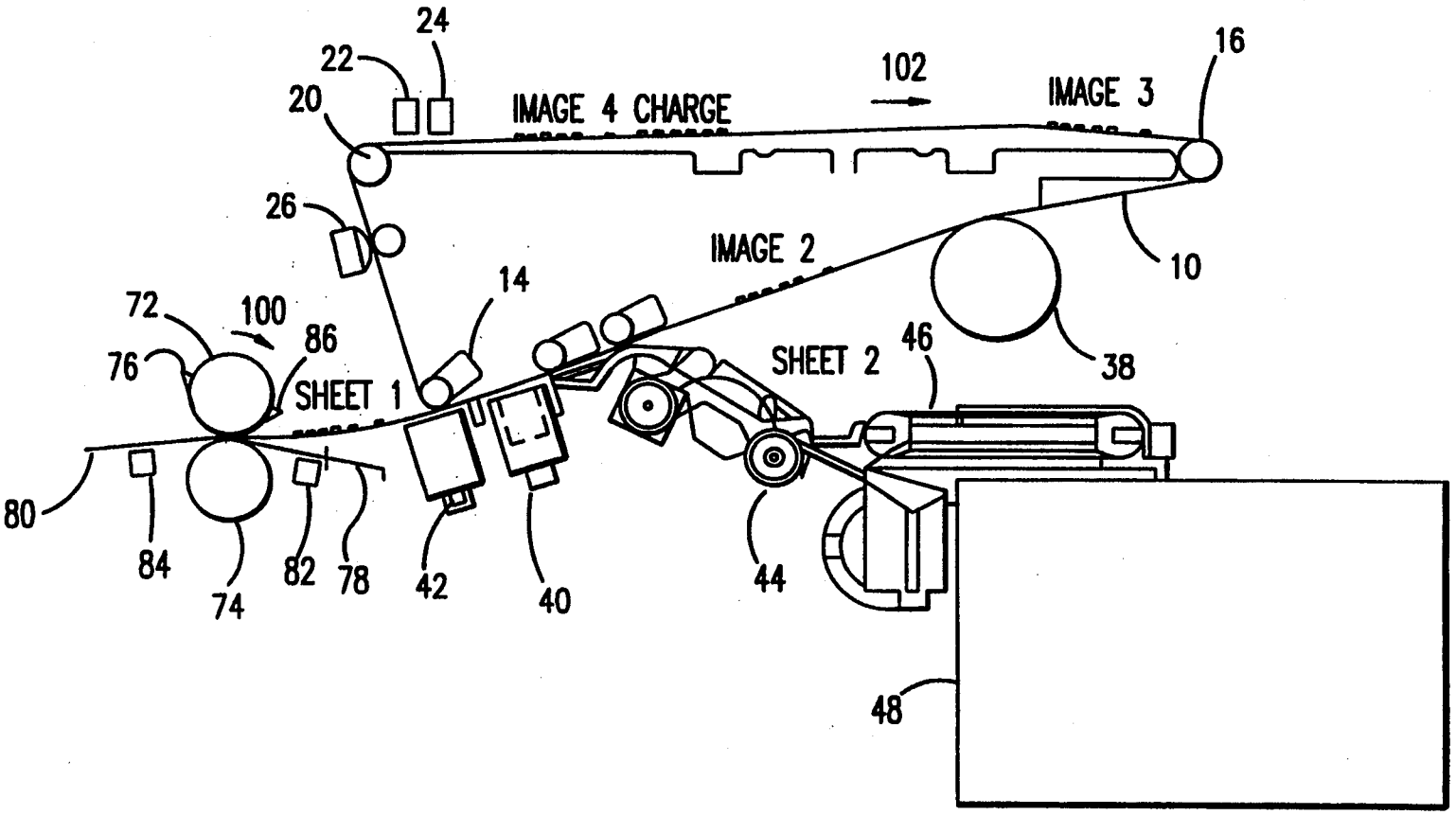
FIGS. 4–6 are diagrams showing the operation of a self-recovering fuser in response to a fuser misstrip.

As illustrated in FIG. 4, the last image scanned (image 4) has to be rescanned because it was requested prior to entering the misstrip recovery processing. The paper transport is turned on a predetermined number of clock counts after the photoreceptor belt is returned to process speed. This ensures that the lead edge of the copy sheet 2 and the developed image are registered when they arrive at the transfer point.

The copier is returned to standard run control and every counter is updated to reflect the passage of the recovered copy sheet and the elapsed clock counts.

Figure 5:
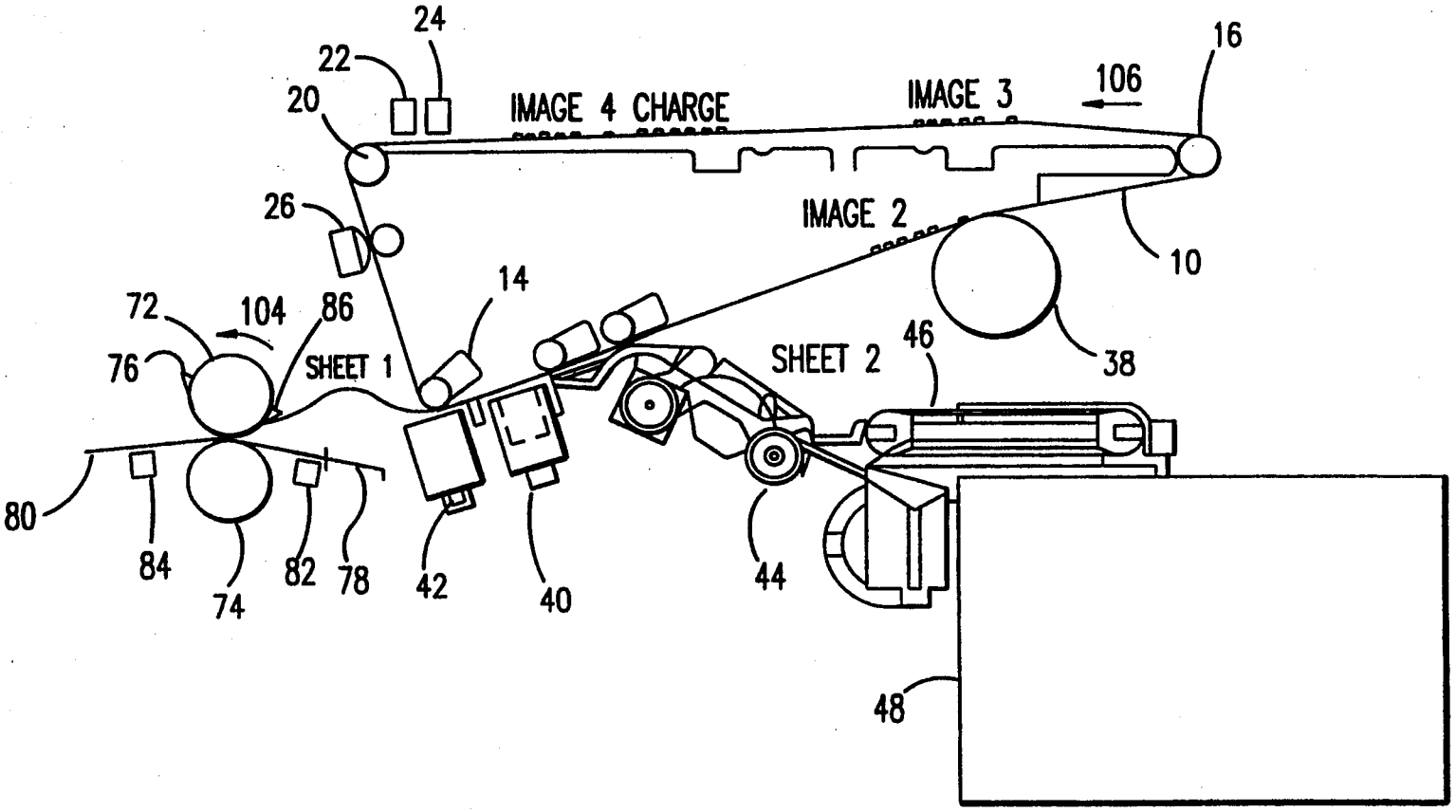
Figure 6:
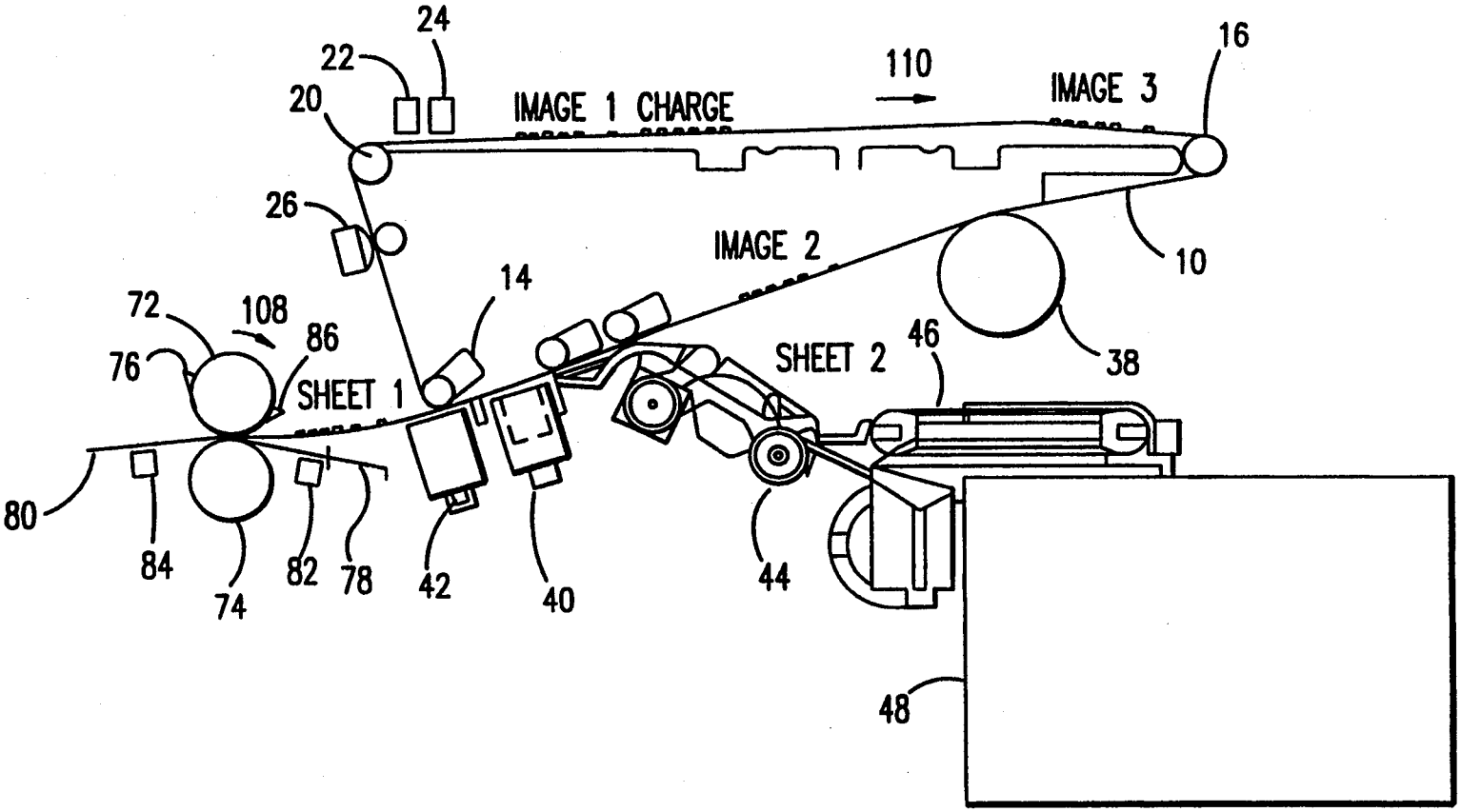

FIGS. 4–6 show the operation of the self-recovering fuser assembly in response to a fuser misstrip. In FIG. 4, the paper (sheet 1) with the toner is moving toward the fuser sub-assembly just before jamming. At this point the fourth page to be copied has been charged on the photoreceptor belt 10. The sheet 1 just entering the fuser roller 72 is guided by the pre-fuser paper guide 78. The fuser roller is moving in the forward (clockwise in this drawing) direction 100 and the belt 10 is moving in the forward (also clockwise) direction 102.

In FIG. 5, a paper jam has been detected because the post-fuser sensor 84 has not been triggered, therefore the timer has reached zero. Either the copy sheet is jammed or crumpled before passing between the fuser and pressure rollers or the copy sheet is not being stripped by the standard stripper fingers 76. Since the counter is at zero, the system moves into a fuser misstrip recovery program. The direction of the fuser roller 72 has been reversed so that the fuser roller is moving in the direction of the arrow 104. The photoreceptor drive roller is also reversed so that the belt is moving in the direction of the arrow 106. If the paper is still attached to the fuser roller 72, the recovery stripper fingers 86 will help remove the copy sheet from the fuser roller 72. Once the photoreceptor belt 10 has been backed the appropriate distance so that the sheet has been completely removed from the fuser roller, then the system can be begin to move in the forward direction.

In FIG. 6, the photoreceptor drive roller 20 and the fuser roller 72 are rotating in the direction of the arrows 108 and 110, respectively. The copy sheet is again moved toward the fuser roller with assistance form the pre-fuser paper guide 78. Usually, the copy sheet will pass between the fuser roller 72 and pressure roller 74 and trigger the post-fuser sensor 84. At this point, the paper jam has been cleared automatically and the machine will continue normal operation. In other words, images 2 and 3 can continue to move toward the fuser.

A photocopying machine may have a fuser transfer belt. This belt is located between the stripping zone of the photoreceptor belt and the fuser roller. The copy sheet is transferred from the photoreceptor belt and onto the fuser transfer belt. The pre-fuser sensor will then detect the copy sheet before it passes between the fuser roller and the pressure roller.

Another method of automatically recovering from a fuser misstrip is to reverse the direction of only the fuser roller. Once a fuser misstrip has been detected, the fuser roller and the photoreceptor drive roller are slowed until the fuser and the photoreceptor belt are stopped. The fuser roller is driven in the reverse direction until the copy sheet has a buckle in it. The recovery stripper fingers 86 will assist in removing the copy sheet from the fuser roller. The fuser roller and the photoreceptor drive roller are driven in the forward direction. The copy sheet should pass between the fuser roller and pressure roller without jamming.

Figure 7:
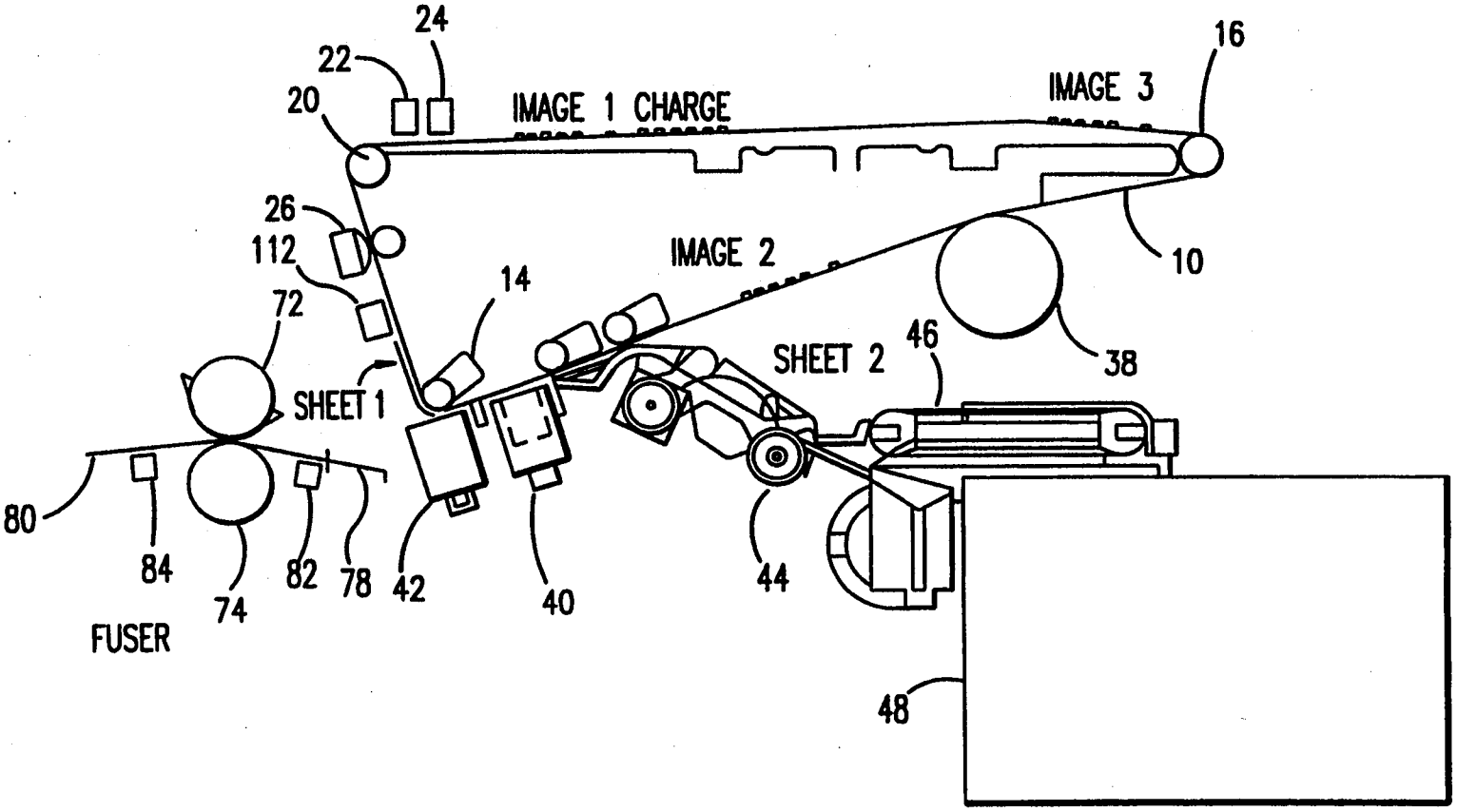
FIG. 7 is a diagram for a self-recovering system in response to a photoreceptor misstrip.

Next, automatic recovery for a photoreceptor misstrip will be explained with reference to FIG. 7. A photoreceptor misstrip occurs when the copy sheet does not detack properly from the photoreceptor belt. After transfer of the toner to the copy sheet, the detack corotron 42 charges the copy sheet to an opposite polarity to detack the copy sheet from the belt 10. Usually the sheet will strip from the belt 10 at the stripping roller 14 and move toward the fusing station.

If the copy sheet remains attached to the belt 10, it will jam when the copy sheet is attempting to enter or has entered the cleaner module 26. At this point, the operator must manually remove the copy sheet from the cleaner module. A "paper on photoreceptor" sensor 112 is located a short distance downstream from the strip zone. If the copy sheet triggers the photoreceptor sensor 112, the system enters recovery mode. The photoreceptor drive roller stops and reverses direction of the belt 10. The copy sheet is backed up to re-expose the tacked sheet's lead edge to the detack corotron field in the detack corotron 42. The photoreceptor drive roller then moves forward in order to attempt stripping again.

A photoreceptor misstrip can be identified without the photoreceptor sensor 112. Another counter is started which waits for the copy sheet to trigger the pre-fuser sensor 82. If the sensor is not triggered, then the system enters recovery mode. As in the situation above, the photoreceptor drive roller is reversed until the copy sheet is re-exposed to the detack corotron field. Then the photoreceptor drive roller is moved forward to attempt stripping of the copy sheet which should trigger the pre-fuser sensor 82.

Although the invention has been described and illustrated with particularity, it is intended to be illustrative of preferred embodiments and understood that the present disclosure has been made by way of example only, and numerous changes in the combination and arrangements of the parts and features can be made by those skilled in the art without departing from the spirit and scope of the invention, as hereinafter claimed.

What is claimed is:

1. A fuser assembly in an electrophotographic device for automatically recovering from a substrate jamming in the fuser assembly without operator intervention, the electrophotographic device comprising a charge retentive surface for carrying latent images, a developer for developing the latent images with toner, a transfer station for transferring the developed latent images to the substrate, a feeder system for forwarding the substrate in a feed direction to the transfer station, and a fuser station located downstream of the transfer station in the feed direction for fusing the toner to the substrate, said fuser assembly being part of the fuser station and comprising:

a fuser roller for applying heat to the substrate and axially rotatable in the feed direction and a reverse feed direction;

a pre-fuser sensor for sensing a lead edge of the substrate before the toner is fused to the substrate, said pre-fuser sensor being located upstream of the fuser roller in the feed direction;

a post-fuser sensor for sensing the lead edge of the substrate after the toner is fused to the substrate, said post-fuser sensor being located downstream of the fuser roller in the feed direction; and a controller operating the fuser roller in the reverse feed direction when the sensors detect the substrate jamming in the fuser assembly, and subsequently operating the fuser roller in the feed direction to elect the substrate from the fuser assembly.

2. A fuser assembly as claimed in claim 1, further comprising recovery stripper fingers for stripping the substrate from the fuser roller, the recovery stripper fingers contacting the fuser roller on an upstream side of the fuser roller.

3. A fuser assembly as claimed in claim 1, further comprising standard stripper fingers for stripping the substrate from the fuser roller after the toner is fused to the substrate, the standard stripper fingers contacting the fuser roller on a downstream side of the fuser roller.

4. A fuser assembly as claimed in claim 1, further comprising a pre-fuser paper guide for guiding the substrate in the feed direction toward the fuser roller.

5. A fuser assembly as claimed in claim 1, further comprising a post-fuser paper guide for guiding the substrate leaving the fuser roller.

6. A fuser assembly as claimed in claim 4, wherein the pre-fuser sensor is supported by the pre-fuser paper guide.

7. A fuser assembly as claimed in claim 5, wherein the post-fuser sensor is supported by the post- fuser paper guide.

8. A fuser assembly as claimed in claim 1, further comprising a pressure roller for applying pressure to the fuser roller and axially rotatable in the clockwise and counterclockwise directions.

9. A fuser assembly as claimed in claim 1, further comprising a timer for measuring a time period between which the substrate actuates both the pre-fuser sensor and the post-fuser sensor.

10. An electrophotographic device for automatically recovering from a substrate jamming in the cleaner assembly without operator intervention, the electrophotographic device comprising a charge retentive surface for carrying latent images, a developer for developing the latent images with toner, a transfer station for transferring the developed latent images to the substrate, a feeder system for forwarding the substrate in a feed direction to the transfer station, a fuser station located downstream of the transfer station in the feed direction for fusing the toner to the substrate, and a cleaner station located downstream from the transfer station for cleaning the charge retentive surface, the electrophotographic device further comprising:

a post-transfer sensor for sensing the lead edge of the substrate, the post-transfer sensor being actuated when the transfer of the substrate to the fuser station was unsuccessful and the substrate is moving toward the cleaner station; and a controller operating the charge retentive surface in a reverse feed direction when the post-transfer sensor senses the lead edge of the substrate, and subsequently operating the charge retentive surface in the forward feed direction to perform the transfer of the substrate to the fuser station.

11. An electrophotographic device as claimed in claim 10, wherein the post-transfer sensor is located after the transfer station and before the cleaner station.

12. A fuser assembly in an electrophotographic device for automatically recovering from a substrate jamming in the fuser assembly without operator intervention, the electrophotographic device comprising a charge retentive surface for carrying latent images, a developer for developing the latent images with toner, a transfer station for transferring the developed latent images to the substrate, a feeder system for forwarding the substrate in a feed direction to the transfer station, and a fuser station located downstream of the transfer station in the feed direction for fusing the toner to the substrate, said fuser assembly being part of the fuser station and comprising:

fusing means for fusing the toner to the substrate;

first detecting means for detecting the lead edge of the substrate upstream of the fusing means;

second detecting means for detecting the lead edge of the substrate downstream of the fusing means; and controlling means for initiating a reverse feed direction of the fuser means when the sensors detect the substrate jamming in the fuser assembly, and for subsequently initiating a feed direction of the fuser means to fuse the toner to the substrate.

13. The fuser assembly as claimed in claim 12, wherein the fusing means comprises a fuser roller for applying heat to the toner and the substrate.

14. The fuser assembly as claimed in claim 13, wherein the fusing means further comprises a pressure means for applying pressure to the fuser roller.

15. The fuser assembly as claimed in claim 14, wherein the pressure means is a pressure roller.

16. The fuser assembly as claimed in claim 12, wherein the first detecting means is a sensor.

17. The fuser assembly as claimed in claim 12, wherein the first detecting means is attached to a pre-fusing substrate guide means for guiding the substrate toward the fusing means.

18. The fuser assembly as claimed in claim 12, wherein the second detecting means is a sensor.

19. The fuser assembly as claimed in claim 12, wherein the second detecting means is attached to a post-fusing substrate guide means for guiding the substrate leaving the fuser means.

20. The fuser assembly as claimed in claim 12, wherein a stripping means is in contact with the fusing means for assisting in removing the substrate from the fusing means.

21. The fuser assembly as claimed in claim 20, wherein the stripping means are located on an upstream side of the fusing means.

22. The fuser assembly as claimed in claim 20, wherein the stripping means are located on a downstream side of the fuser means.

23. The fuser assembly as claimed in claim 12, further comprising a timer means for timing a time period between which the substrate actuates both the first detecting means and the second detecting means.

24. An electrophotographic device for automatically recovering from a substrate jamming in a cleaner assembly without operator intervention, the electrophotographic device comprising:

a charge retentive surface for carrying latent images, a developer for developing the latent images with toner;

a transfer station for transferring the developed latent images to the substrate;

a feeder system for forwarding the substrate in the feed direction to the transfer station;

a fuser station located downstream from the transfer station for fusing the developed latent image to the substrate;

a cleaner station located downstream from the transfer station for cleaning the charge retentive surface;

detecting means for detecting when the transfer of the substrate to the fuser station was unsuccessful and the substrate is moving toward the cleaner station; and controlling means for initiating a reverse direction of the charge retentive surface when the detecting means detects the substrate moving toward the cleaner station, and for subsequently initiating the forward feed direction of the charge retentive surface to perform the transfer of the substrate to the fuser station.

25. An electrophotographic device as claimed in claim 24, wherein the detecting means comprises a sensor.

26. An electrophotographic device as claimed in claim 24, wherein the detecting means is located after the transfer station and before the cleaner station.

27. An electrophotographic device as claimed in claim 24, wherein the detecting means is located upstream of the fuser station and detects that the substrate has failed to move in the feed direction toward the fuser station.

28. A method for automatically recovering from a substrate jamming in a fuser assembly in an electrophotographic device without operator intervention, the electrophotographic device comprising a charge retentive surface for carrying latent images, developers for developing the latent images with toner, a transfer station for transferring the developed latent images to the substrate, a feeder system for forwarding the substrate in a feed direction to the transfer station, and a fuser station located downstream from the transfer station for fusing the toner to the substrate, the method comprising the steps of:

sensing that the substrate has jammed in the fusing station;

reversing a direction of the substrate until it ceases from being jammed in the fuser station; and re-inserting the substrate into the fusing station.

29. A method for automatically recovering from a substrate jamming in a fuser assembly as claimed in claim 28, wherein the steps are repeated until the substrate successfully proceeds through the fuser station.

30. A method for automatically recovering from a substrate jamming in a cleaner assembly of an electrophotographic device without operator intervention, the electrophotographic device comprising a charge retentive surface for carrying latent images, developers for developing the latent images with toner, a transfer station for transferring the developed latent images to the substrate, a feeder system for forwarding the substrate in a feed direction to the transfer station, a fuser station located downstream from the transfer station for fusing the toner to the substrate, and the cleaner assembly located downstream from the transfer station for cleaning the charge retentive surface, the method comprising the steps of:

sensing that the substrate is moving toward the cleaning station;

reversing a direction of the substrate until it is in position to move toward the fuser station;

changing the direction of the substrate so that it moves in the feed direction toward the fuser station.

31. A method for automatically recovering from a substrate jamming in a cleaner station as claimed in claim 30, wherein the steps are repeated until the substrate successfully proceeds toward the fuser station.

32. A method for automatically recovering from a substrate jamming in a cleaner station as claimed in claim 30, wherein sensing the substrate is moving toward the cleaning station is in response to the failure of actuating a pre-fuser sensor.

33. The fuser assembly of claim 1, wherein the controller operates the charge retentive surface in the reverse feed direction when operating the fuser roller in the reverse feed direction, and subsequently operates the charge retentive surface in the feed direction when operating the fuser roller in the feed direction.

34. The fuser assembly of claim 12, wherein the controlling means operates the charge retentive surface in the reverse feed direction when operating the fuser means in the reverse feed direction, and subsequently operates the charge retentive surface in the feed direction when operating the fuser means in the feed direction.

* * * * *